United States Patent [19]

Scott et al.

[11] Patent Number: 4,931,014

[45] Date of Patent: Jun. 5, 1990

[54] BEVELED GLASS CANDLE HOLDER

[76] Inventors: Edward J. Scott; Deborah B. Scott, both of 14950 N. 85th Dr., Peoria, Ariz. 85345

[21] Appl. No.: 290,465

[22] Filed: Dec. 27, 1988

[51] Int. Cl.[5] ..... F23Q 2/32

[52] U.S. Cl. ..... 431/126; 431/289; 431/291; 362/326; 362/339; 362/161; 362/162

[58] Field of Search ..... 431/126, 288, 289, 291; 362/161, 163, 339, 326, 351, 806, 810; 40/428

[56] References Cited

U.S. PATENT DOCUMENTS

| | | | |
|---|---|---|---|
| 1,336,500 | 4/1920 | Berry | 40/428 |
| 1,567,855 | 12/1925 | Meany et al. | 40/428 |
| 1,655,987 | 1/1928 | Dickinson | 40/428 X |
| 1,692,021 | 11/1928 | Auer | 40/428 X |
| 1,768,284 | 6/1930 | Berry | 40/428 |
| 1,827,941 | 10/1931 | Gross | 40/428 |
| 4,017,729 | 4/1977 | Frazier | 362/161 |
| 4,427,366 | 1/1984 | Moore | 431/291 |

*Primary Examiner*—Carl D. Price
*Attorney, Agent, or Firm*—Tod R. Nissle

[57] ABSTRACT

An improved candle holder having a unique illuminating effect due to many dozens of reflections of the single flame reflecting off individual beveled glass pieces surrounding the candle.

The candle flame is protected from wind by the surrounding bevels and the glass vase.

The inexpensive candle element (which burns 4–5 hours) is disposable, leaving the investment of the candle holder in tact.

3 Claims, 1 Drawing Sheet

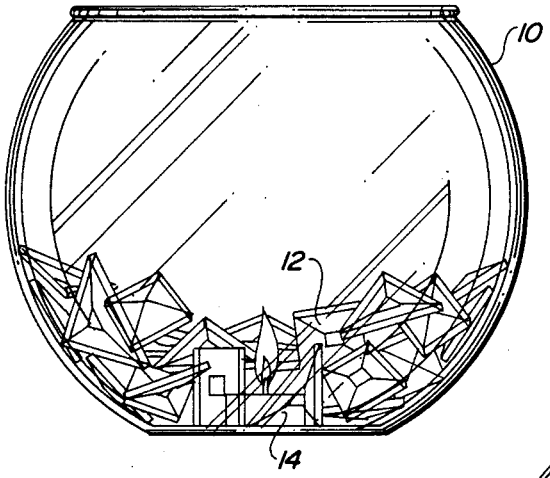
FIG. 1
FIG. 2
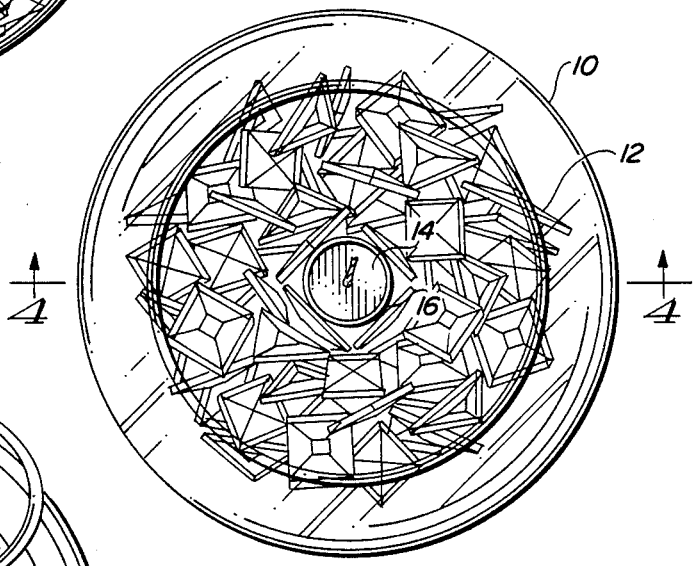
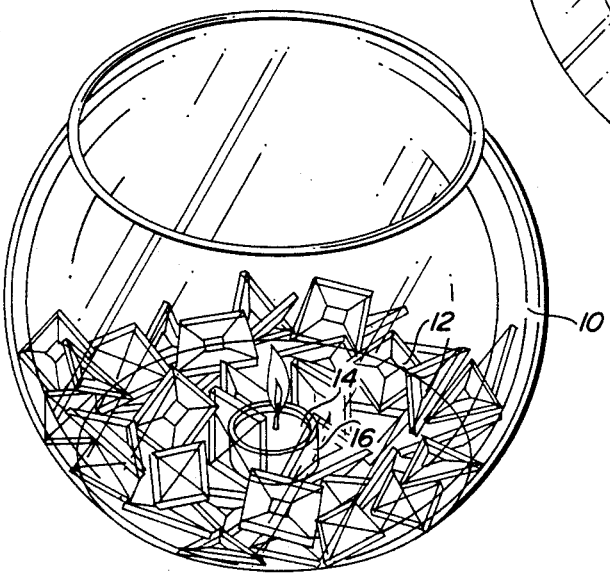
FIG. 3
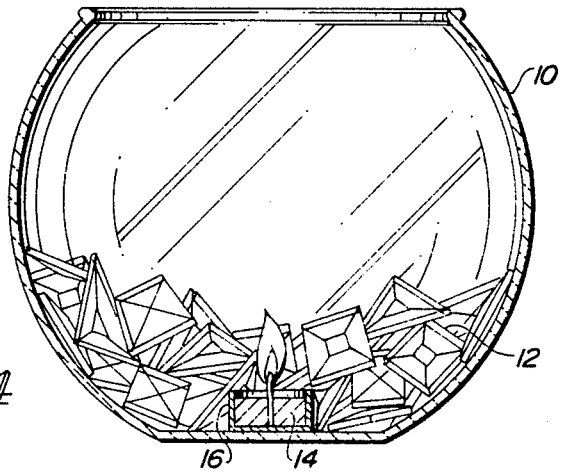
FIG. 4

BEVELED GLASS CANDLE HOLDER

BACKGROUND—FIELD OF INVENTION

This invention relates to candle holders. Specifically, to the use of beveled glass surrounding the candle and its flame, resting in a transparent vase, resulting in multiple reflections of said flame, and general illumination of the entire holder.

BACKGROUND—DESCRIPTION OF PRIOR ART

Candles and candle holders available today tend to have a number of disadvantages that this invention eliminates. This invention also has unique aesthetic qualities.

Most candle holders are designed to accept standard paraffin type wax candles with the only function of the holder being to literally support the candle. The holder does not add to the illuminating effect of the candle itself, and plays strickly a utilitarian role.

The current option to a candle with a holder is a standard candle without a holder. When this type candle is burned as designed, the wax melts along with any decorative design on its sides, and eventually is completely discarded.

Most users therefore, would find it desirable to have a candle holder that would incorporate a very inexpensive, readily available, replacable candle, that leaves no melted wax in or on the holder, that protects the flame from being blown out by wind during use outdoors, and would create an exciting visual effect due to reflections of the single flame.

OBJECTS AND ADVANTAGES

Accordingly, we claim the following as our objects and advantages of the invention.

To provide a candle holder that will receive a liquid wax candle in its own tin retainer, eliminating clean up experienced by standard wax candles.

To provide a candle holder that effectively protects the candle flame from wind for use outdoors, and to utilize beveled glass pieces around the single candle flame causing reflections of the flame to bounce off the angled and straight portions of the beveled glass creating dozens of reflections and illuminating the entire glass vase.

DRAWING FIGURES

FIG. 1 is a side elevation view of the beveled glass candle holder.

FIG. 2 is a top plan view of the beveled glass candle holder.

FIG. 3 is a perspective view of the beveled glass candle holder.

FIG. 4 is a sectional view of the beveled glass candle holder.

REFERENCES NUMERALS

10. Glass vase
12. Beveled glass pieces
14. Liquid wax candle
16. Tin retainer

BEVELED GLASS CANDLE HOLDER—DESCRIPTION

FIG. 1 shows a side view, and the preferred embodiment of the invention.

The candle holder comprises a transparent glass vase 10, beveled glass pieces 12 with a minimum of one beveled side per piece, which sit randomly in the vase 10. The single wick liquid wax candle 14, with its own tin retainer 16 sits loose in the approximate center of the vase 10.

BEVELED GLASS CANDLE HOLDER—OPERATION

The beveled glass candle holder has a number of attributes including, resistance of the flame being blown out by the wind, and ease of discarding the used candle 14, and its retainer 16, without having to clean or discard any other part of the holder. But users will find the most exciting feature, the many dozens of reflections of the single flame as it bounces back and forth off the glass bevels 12.

To prepare the candle holder for use, the liquid wax candle 14 with its own retainer 16 is placed loose in the approximate center of the glass vase 10.

The next step involves placing the first few pieces of beveled glass 12 against the candle's tin retainer 16. The balance of the beveled glass pieces 12 are placed randomly around the candle 14, and the other faces, and edges of beveled glass 12 as the pieces climb part way up the inside face of the vase 10.

When the desired number of beveled glass pieces 12 are placed in the vase 10, the candle's retainer 16 is not only retaining the liquid wax when the candle is burned, but also retains the beveled glass 12 around the candle 14.

The user then lights the candle 14 with a long stick match.

The entire procedure described takes a few minutes, and is designed for the beveled glass 12, and the candle 14 to remain loose and unattached to facilitate removal for occasional cleaning.

The unique illuminating effect begins as soon as the candle is lit.

I believe the illuminating effect occurs because of the many bevels near the open flame.

CONCLUSION AND SCOPE

In conclusion, this new candle holder does much more than simply hold a candle.

The illuminating effect created by the bevels is truly impressive and unique. The functional aspects such as resistance to wind, and the only discarded element is the very inexpensive liquid wax candle is also desirable.

The description contains some specificities, the reader should not construe these as limitations on the scope of the invention, but merely as exemplifications of preferred embodiments thereof. Those skilled in the art may envision other dimensions and shapes of the various embodiments. For example, they may make variations to the shape of the glass vase. Accordingly, the reader is required to determine the scope of the invention by the appended claims and their legal equivalents, and not by the examples which have been given.

We claim:

1. In combination with a support surface, a device for refracting light emanating from a selected point on the device, said device resting on said support surface and including (a) a container including (i) a base having an upper surface, and (ii) an outer transparent wall extending upwardly from said base;

(b) candle means sized to be loosely placed inside said container at a selected position on said upper surface of said base spaced away from said wall and including an outer upright wall circumscribing said candle means;

(c) a stack of randomly oriented transparent light refracting beveled glass prism pieces placed in said container on said base, said beveled glass pieces (i) circumscribing and in part contacting and bearing against said outer upright wall of said candle means and said wall of said container to maintain said candle means in said selected position on said base and to prevent said candle means from loosely moving over said upper surface of said base, (ii) extending upwardly from said base and intermediate said candle means and said outer wall of said container, and (iii) in part, extending above said candle means such that a portion of light emanating upwardly and outwardly from said candle means is refracted through said outer wall through said outer wall of said container by certain of said beveled glass prism pieces extending above said candle means.

2. The combination of claim 1, wherein said transparent wall of said container is shaped and dimensioned such that a portion of light emanating from said candle means is downwardly refracted by said beveled glass prism pieces and passes intermediate said candle means and a portion of said wall of said container and through said wall of said container and visibly onto said support surface.

3. The combination of claim 1 wherein a portion of light emanating upwardly and downwardly from said candle means is outwardly refracted by said certain of said beveled glass prism pieces extending above said candle means and extending intermediate said candle means and said transparent wall of said container, said downwardly refracted light passing intermediate said candle means and a portion of said wall of said container and through said transparent wall of said container and onto said support surface.

* * * * *